United States Patent [19]

Verry

[11] Patent Number: 4,942,537

[45] Date of Patent: Jul. 17, 1990

[54] SYSTEM FOR ASSEMBLING AND DISASSEMBLING A MAST

[75] Inventor: Edward H. Verry, Old Orchard Beach, Me.

[73] Assignee: Fiber Materials, Inc., Biddeford, Me.

[21] Appl. No.: 285,051

[22] Filed: Dec. 15, 1988

[51] Int. Cl.[5] ..... E04H 12/00; G06F 15/20

[52] U.S. Cl. ..... 364/512; 364/505; 52/111; 52/123.1; 52/726; 52/110

[58] Field of Search ..... 364/512, 505; 52/123.1, 52/111, 114, 121, 726, 110; 135/88, 99, 120, 905, 107, 108; 318/567, 569, 600; 187/9 R

[56] References Cited

U.S. PATENT DOCUMENTS

| | | | |
|---|---|---|---|
| 2,863,531 | 12/1958 | Campbell | 52/123.1 |
| 2,998,106 | 8/1961 | Aust | 52/726 |
| 3,150,740 | 9/1964 | Rubeli | 52/111 |
| 3,185,265 | 5/1965 | White | 52/114 |
| 3,751,863 | 8/1973 | Lyons | 52/111 |
| 4,420,917 | 12/1983 | Parlanti | 52/123.1 |
| 4,569,176 | 2/1986 | Hedgepeth et al. | 52/111 |
| 4,625,475 | 12/1986 | McGinnis | 52/111 |
| 4,782,920 | 11/1988 | Gaibier et al. | 187/9 R |

FOREIGN PATENT DOCUMENTS

| | | | |
|---|---|---|---|
| 0296957 | 12/1988 | European Pat. Off. | 52/111 |

*Primary Examiner*—Parshotam S. Lall
*Assistant Examiner*—Ellis B. Ramirez
*Attorney, Agent, or Firm*—Schiller, Pandiscio & Kusmer

[57] ABSTRACT

An apparatus for assembling or disassembling a mast comprising a plurality elongate mast sections adapted to be attached together in end-to-end configuration. The apparatus includes a lifting assembly for raising or lowering the mast from its bottom end, and a plurality of winches for reeling in or feeding out guy lines attached to the mast. The apparatus also includes a computer for controlling the operation of the winches so as to ensure the length of guy line fed out of the winches is such that the mast is supported in a substantially vertical position.

10 Claims, 5 Drawing Sheets

SYSTEM FOR ASSEMBLING AND DISASSEMBLING A MAST

This invention was made with Government support under Contract No. DAAB07-83-C-K588 awarded by the U.S. Army. The Government has certain rights in this invention.

The present invention relates generally to mobile mast-erecting systems, and more particularly to such apparatus for and methods of erecting tall masts or towers on terrain that may not be level.

In a number of instances, it is desirable to provide a quickly and easily erectable mast, particularly where it is expected that employment of the mast will be temporary, for example as a radio transmission antenna or the like, and thus does not warrant the expense of erecting a permanent structure. Some quick-erecting towers, masts and antennae fall into the category of initially unassembled structures that require the tower to be first fully assembled in a horizontal position from individual loose parts and then raised to a vertical position. Alternatively, a standard practice is to assemble the tower from individual, initially unassembled section and build or assemble from the bottom vertically. This latter technique may require construction personnel to climb the tower or be hoisted to the top to clamp the parts together and attach any stabilizing guy lines.

Some masts are provided as preassembled systems, i.e. structures that are stored in a partially assembled form so that the tower or mast can easily be extended to its operating height. Some examples of preassembled systems are the well-known nested tube mast and nested truss designs. The usual height for a preassembled mast for antennas for ground use is less than 150 feet although some systems are designed to extend to 175 feet. Because they are relatively short, many of the preassembled masts do not employ guy supports, and the mast is raised to a vertical position with little if any control of verticality, a risky venture.

Many masts, preassembled or otherwise, use guy lines to stabilize the mast and maintain it in a vertical position during and after erection of the mast. A number of systems have been developed for keeping a substantially constant tension on the guy lines during erection.

For example, U.S. Pat. No. 4,420,917 issued Dec. 20, 1983 to Parlanti discloses a guy line tensioning system for a nested tower in which a winch for the lines is driven by an electromagnetic clutch. Because the degree of engagement of the clutch is dependent upon the voltage applied to the clutch by manual operation of a control by an operator, the system is not mechanically interactive and depends upon the judgement of the operator.

In U.S. Pat. No. 3,150,740 issued Sept. 29, 1964 to Rubeli, a mechanically interactive, cam-operated controller is provided for synchronizing the raising of a mast and concurrent maintenance of tension of the guy lines. The use of the Rubeli system however, is clearly limited to comparatively short masts because the height of the continuous cam required is dependent upon the height of the mast, an unwieldy and impractical approach for tall masts.

Both the Rubeli and Parlanti structures require that the guy lines be brought back by winches or pulleys to an area near the base of the mast, and require particularly that the winch locations, and thus the ground around the mast, be located in a substantially level area to maintain suitable geometry of the guy lines and mast. The winches in these patents all dispense equal lengths of line as the mast is raised, thus keeping it straight and vertical only if the winches are located in a plane normal to the axis of the mast, i.e. on level ground.

It is therefore a principal object of the present invention to provide a quick-erection system for raising temporary or permanent masts or towers above an uneven or unlevel ground site. Yet other objects of the present system invention are to provide such a system in which each of the several winches of the system are capable of reeling in or feeding out guy line independently of the other winches, so that some of the winches can reel in guy line while other of the winches are feeding out guy line and so that unequal lengths of guy line may be fed out or reeled in over a selected period of time as compared between the several winches of the system; to provide such a system that permits the erection of masts to much higher heights than has heretofore been generally practicable; to provide such a system that allows the mast to be erected at ground level and does not expose operating personnel to the hazards of having to climb the mast as it is assembled; and to provide such a system that includes a set of guy lines and a control system for maintaining the mast in a vertical position during and after erection by interactively controlling the length of the guy lines based on the height of the mast, the horizontal and vertical spacing between each winch and the surface on which the tower erection apparatus rests, and known trigonometric and geometric formulae.

To effect the foregoing and other objects, the present invention generally comprises fixed lengths of unassembled, individual, tower or mast components, erecting means for assembling the mast components in a vertical direction from the ground up, guy lines each having an end coupled to an upper portion of the mast, guy winches dispensing the guy lines, each winch being located at a known distance from and elevation above or below the base of the mast, and control means for maintaining the mast in a vertical orientation during and upon erection of the mast to its full height. The control means, responsively to signals from the erecting means, determines on the basis of the distance and angular elevation of each winch from the mast base, and from the height of the mast at the point of coupling to the guy line, the amount of line that must be dispensed by each winch to maintain the mast in a vertical orientation.

The mast is erected utilizing the top sections first, raising the top sections and installing successive lower sections under the raised upper sections. During the erecting operation, at the time that the mast is fully raised, and during any lowering operation, the lengths of the guy lines are adjusted so that the mast is supported in a vertical position.

Other objects of the present invention will in part appear obvious and will in part appear hereinafter. The invention accordingly comprises the apparatus possessing the features, properties and relation of components, and the method involving the several steps and the relation and order of one or more of such steps with respect to each of the others, all of which are exemplified in the following detailed disclosure and the scope of the application of which will be indicated in the claims.

For a fuller understanding of the nature and objects of the present invention, reference should be had to the following detailed description taken in connection with the accompanying drawings in which like numerals denote like parts, and wherein.

Figure 1:
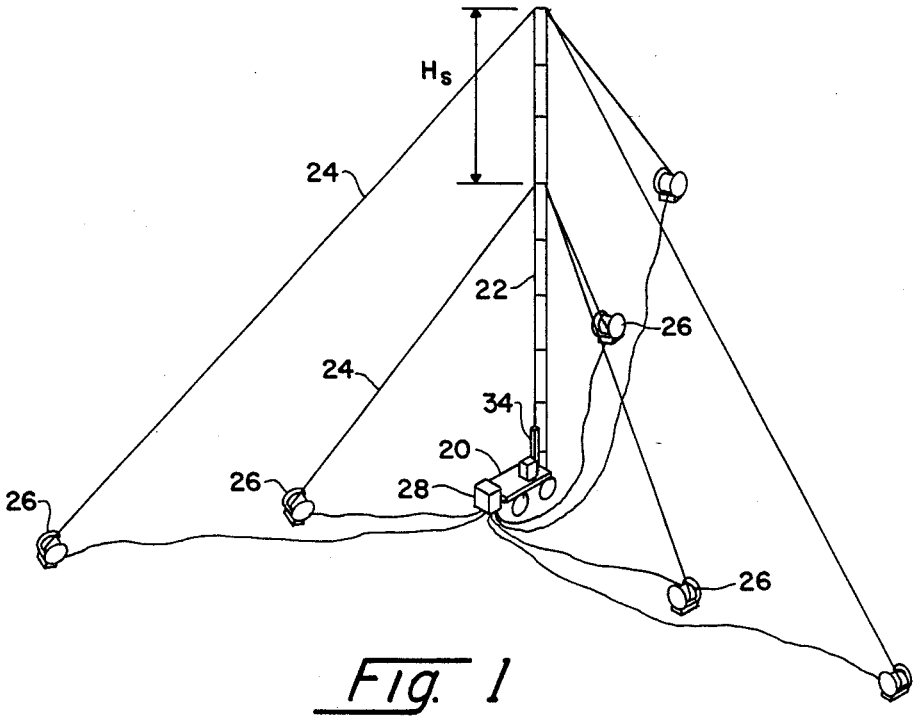
FIG. 1 is a perspective view of a mast assembly and erecting apparatus embodying the principles of the present invention.

Briefly describing the present invention, there is shown in FIG. 1 a mast lifting assembly 20 for erecting and lowering individual mast sections forming mast 22. The latter may be of truss, rod or tube construction, as appropriate for the selected application.

An upper portion of mast 22 is coupled to respective first ends of a plurality of guy lines 24 which serve to stabilize the mast and maintain it in a vertical position. The other ends of guy lines 24 are connected to means such as winches 26 for dispensing lengths of the guy lines. Winches 26 may be designed to also store the guy lines. Alternatively, separate guy line storage devices (not shown) positioned adjacent the winches may be used to store the guy lines.

Winches 26 are under the control of computer 28, for lengthening and shortening the corresponding guy lines on command so that mast 22 is supported in a substantially vertical position.

Referring next to FIGS. 1–4 in connection with the following more detailed description of the present invention, mast lifting apparatus 20 preferably comprises a mobile base 30 having a flat surface 32 which is spaced a distance $H_e$ (see FIG. 3) above the surface on which the base rests. The value for $H_e$ will of course vary depending upon the dimensions of mobile base 30 and depending upon the spacing between flat surface 32 and tho ground on which the mobile base 30 rests.

Preferably, although not necessarily, an aperture 33 sized to receive a section of mast 22 may be provided extending through mobile base 30 directly beneath the bottom-most mast section. Aperture 33 is open to the end of the mobile base 30 so that the latter can be moved away from a mast 22 which extends through aperture 33 and has been positioned to rest on a footing or the ground, as discussed hereinafter. During the mast erection procedure, aperture 33 may be closed off by, for instance, a flat plate (not shown) resting on adjacent portions of surface 32 of base 30.

Alternatively, in place of aperture 33, mobile base 30 may be shortened so that no portion of the base extends beneath mast 22. In this case, new mast sections are first positioned on the ground or on a footing provided beneath mast 22 and are then attached to the bottom-most section of mast 22, as described in greater detail hereinafter.

Mast lifting apparatus 20 comprises a vertical member 34 and a lifting carriage 36 movably mounted to the vertical member. Vertical member 34 is attached to base 30 so as to extend normally to flat surface 32. Vertical member 34 has a length somewhat greater than the length of the longest individual section of mast 22, e.g. vertical member may have a length of 24 feet when the longest mast section is 20 feet. Lifting carriage 36 drivingly engages vertical member 34 and is adapted to move along the length of the latter between a bottom position where lifting carriage 36 contacts or nearly contacts flat surface 32 of mobile base 30 and a top position adjacent the upper end of the vertical member.

By way of example but not limitation, vertical member 34 may comprise a rack gear and lifting carriage 36 may comprise a pinion gear and a reversible electric motor coupled to drive the pinion gear. The pinion and rack gears are designed to engage one another such that when the electric motor is operated in a forward direction lifting carriage 36 moves upwardly along vertical member 34. Similarly, when the electric motor is operated in a reverse direction, lifting carriage 36 moves downwardly along vertical member 34. Other motive means, such as hydraulic or pneumatic motors, hydraulic cylinders, and cable and pulley assemblies may also be satisfactorily employed for driving lifting carriage 36 up and down along vertical member 34.

Vertical member 34 may also include a stop sensor (not shown) located near the top of the vertical member for providing an output signal when the lifting carriage 36 reaches the location on the vertical member where the stop sensor is attached. The stop sensor is coupled with lifting carriage 36 and is designed to provide a stop signal when the lifting carriage reaches the stop sensor. Upon receipt of the stop signal, the lifting carriage stops its upward travel on vertical member 34.

Mast lifting apparatus 20 comprises a suitable servo mechanism 37 for causing the motor driving lifting carriage 36 to operate so that the lifting carriage moves up vertical member 34 when an "up" signal is received, moves down vertical member 34 when a "down" signal as received, and stops on vertical member 34 when a "stop" signal is received. Preferably, servo mechanism 37 is coupled to computer 28 which selectively generates the "up", "down" and "stop" signals, as described in greater detail hereinafter.

Alternatively, servo mechanism 37 may be coupled to a three-position switch (not shown) mounted adjacent lifting mechanism 36. The switch has up, down and off positions. The switch provides respective "up", "down" or "off" signals, depending upon its switched state, to servo mechanism 37 whereby the motor for lifting carriage 36 is operated to cause the lifting carriage to climb, descend or stop on member 34.

Lifting carriage 36 also comprises conventional attachment fixtures 38, such as known quick-release hooks, for releasably attaching lifting carriage 36 to sections of mast 22. Attachment fixtures 38 are designed to operate between an extended position where the attachment fixtures are positioned to engage a mast section and a retracted position where the attachment fixtures are not positioned to engage a mast section. Thus, when the attachment fixtures are in the extended position and are attached to a section of mast 22, as lifting carriage 36 moves up and down vertical member 34 the section of mast 22 attached to to the lifting carriage, and hence the remainder of the mast extending above the attached section, is moved up or down relative to the vertical member.

Mast lifting apparatus 20 further comprises a conventional carriage height sensor 40 for measuring the vertical distance $H_c$ between flat surface 32 of base 30 and the attachment fixtures 38 coupling the bottom-most mast section with lifting carriage 36. Carriage height sensor 40 may, for instance, take the form of a conventional drum and cable length sensor, with the drum being attached to lifting carriage 36 adjacent attachment fixtures 38 and the free end of the sensor cable being attached to surface 32 of base 30. Carriage height sensor 40 preferably comprises a two-way counter for providing an output signal to computer 28 that is representative of the height $H_c$ attachment fixtures 38 are elevated above flat surface 32 of base 30, at any point in time. The counter of carriage height sensor 40 measures both increases and decreases in the height $H_c$ when a mast 22 is being assembled or disassembled.

Mast lifting apparatus 20 further comprises mast base sensor 42. The latter is positioned on the flat plate (not shown) covering aperture 33, or is positioned on the footing beneath mast 22 when mobile base 30 is shortened so that it does not extend beneath mast 22, so that a bottom portion of the mast will contact the switch when the mast rests on the flat plate or the footing. Mast base sensor 42 is designed to provide a "down" signal when mast 22 contacts the sensor and an "up" signal when mast 22 does not contact the sensor. Mast down switch 42 is coupled to send the "up" and "down" signals to computer 28.

Mast lifting apparatus 20 additionally comprises attachment fixture sensor 44 coupled with attachment fixures 38 for providing an "engaged" signal when the attachment fixtures are coupled with a mast section and a "disengaged" signal when the attachment fixtures are not coupled with a mast section. Attachment fixture sensor 44 is also coupled with computer 28 to provide the "engaged" and "disengaged" signals to the computer.

Figure 2:
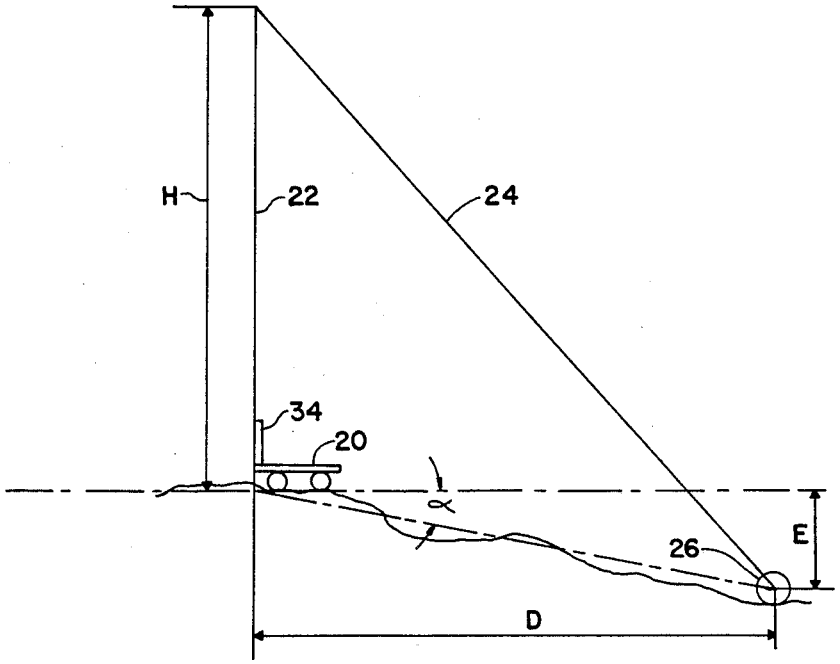
FIG. 2 is a schematic side elevation of the apparatus illustrated in FIG. 1.
Figure 3:
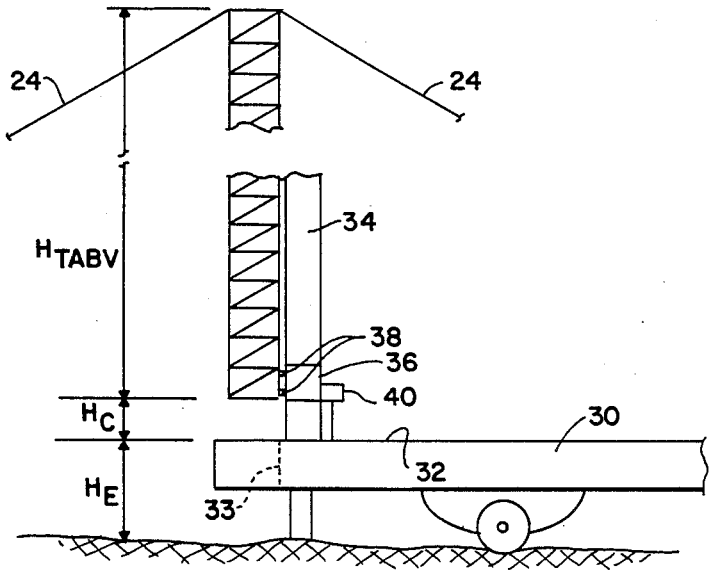
FIG. 3 is an enlarged, detailed view of elements of the erecting carriage of FIG. 2.
Figure 4:
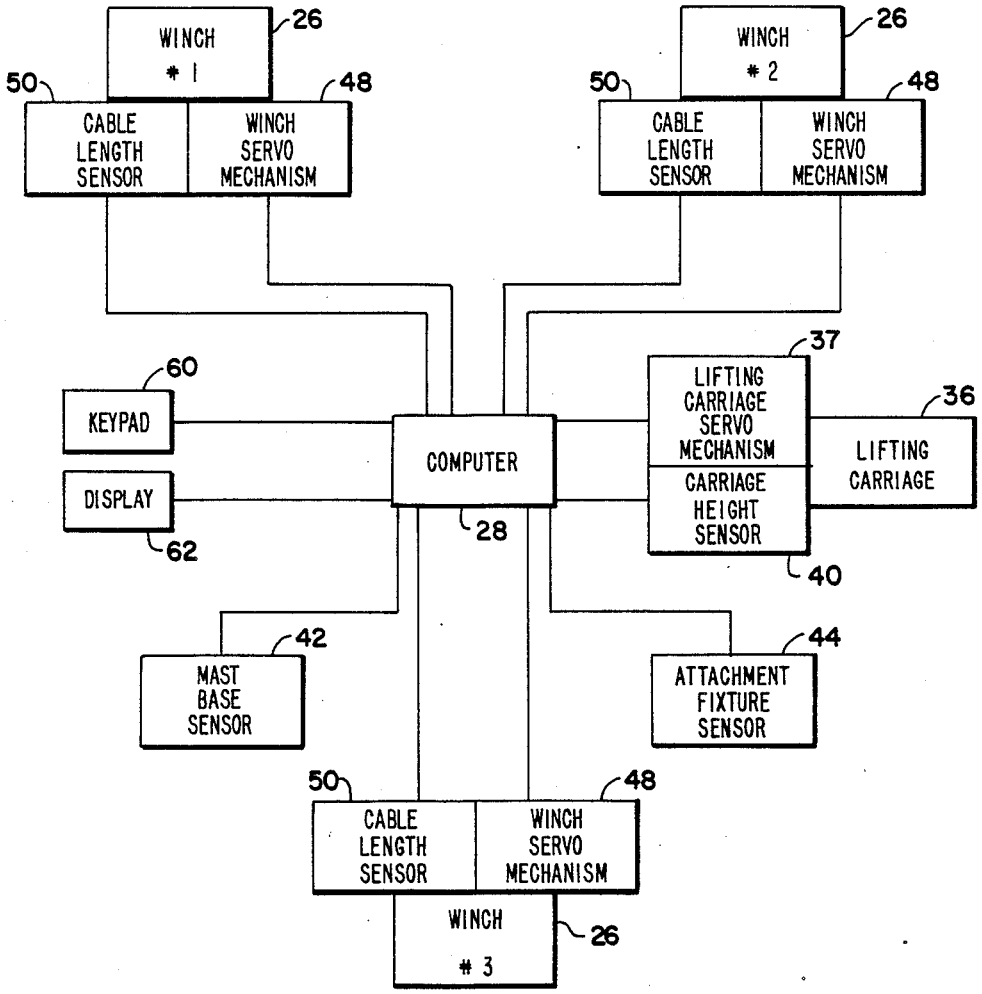
FIG. 4 is block diagram representation of the present invention.

Referring now to FIGS. 1, 2 and 4 the present invention comprises a plurality of, e.g. three, winches 26 respectively spaced from and distributed angularly around the base of mast 22. One winch 26 is generally provided for each guy line 24. Winches 26 are preferably operable by reversible electric motors which are actuated and caused to rotate in the direction selected by a suitable servo mechanism 48. The latter are coupled with computer 28 and are designed to cause the motors of winches 26 to operate in a forward direction so as to pay out guy line when an "out" signal is received from computer 28 and to cause the motors of winches 26 to operate in a reverse direction so as to reel in guy line when an "in" signal is received from computer 28. Additionally, each servo mechanism 48 is designed to halt the rotation of the associated winch 26 when a "stop" signal is received from computer 28.

Also coupled with each winch 26 is a length sensor 50 for measuring the length $L_m$ of guy line that has been unreeled from the winch. This length $L_m$ is, of course, equal to the length of the guy line 24 extending between mast 22 and the drum of the winch. Length sensor 50 comprises a two-way counter for providing an output signal to computer 28 that is representative of the current value of $L_m$. Thus, as guy line 24 is payed out of winch 26 the output signal of length sensor 50 goes increasingly positive if an analog counter is used or increases numerically if a digital counter is used, and as guy line 24 is reeled in the output signal decreases in magnitude or number, as the case may be.

Where mast 22 is erected in uneven terrain, winches 26 are frequently positioned above or below the surface on which mobile base 30 rests. Thus, as shown in FIG. 2 with respect to an exemplary one of winches 26, the latter is positioned a distance E below the elevation of the ground on which mobile base 30 rests. As discussed hereinafter, E may alternatively constitute the angle $\alpha$ between a straight line drawn between the surface on which mobile base rests and winch 26 and a horizontal line intersecting the ground surface on which mobile base 30 rests, both lines being in a common vertical plane. Such a winch 26 is also positioned a horizontal distance D from the vertical axis along which mast 22 extends.

It will be appreciated that the number of winches 26 and respective guy lines 24 employed is a matter of choice for the operator of the equipment, and the nature of the attachment of the lines to the mast and the winches is also a matter of choice inasmuch as the line per se can be single or multiple lines including single or multiple sheaves as desired, or no sheaves at all. It will also be appreciated that the diameter, construction (braided cable, sheathed cable, etc.) and other characteristics of guy lines 24 is also a matter of choice for the operator.

Computer 28 is a ruggedized industrial process control computer. Computer 28 is provided for controlling the operation of winches 26 and lifting carriage 36, as described in greater detail hereinafter, so that a mast 22 being assembled, disassembled, or maintained in a fully assembled state is supported in a vertical position, even when the terrain surrounding the mast is uneven. As noted above, lifting carriage servo mechanism 37, mast height sensor 40, mast base sensor 42 attachment fixture sensor 44, winch servo mechanism 48, and winch cable length sensors 50 are coupled, as with suitable cables, to computer 28. Preferably, although not necessarily, computer 28 is mounted on mobile base 30.

Computer 28 comprises keypad 60 and display 62. Preferably, keypad 60 includes a conventional alphanumeric keyboard. Optionally, keypad 60 may include dedicated "up" and "down" keys and an emergency "stop" button. Display 62 may comprise, for instance, a CRT, an LCD, or other suitable device for displaying information generated by computer 28.

Figure 5:
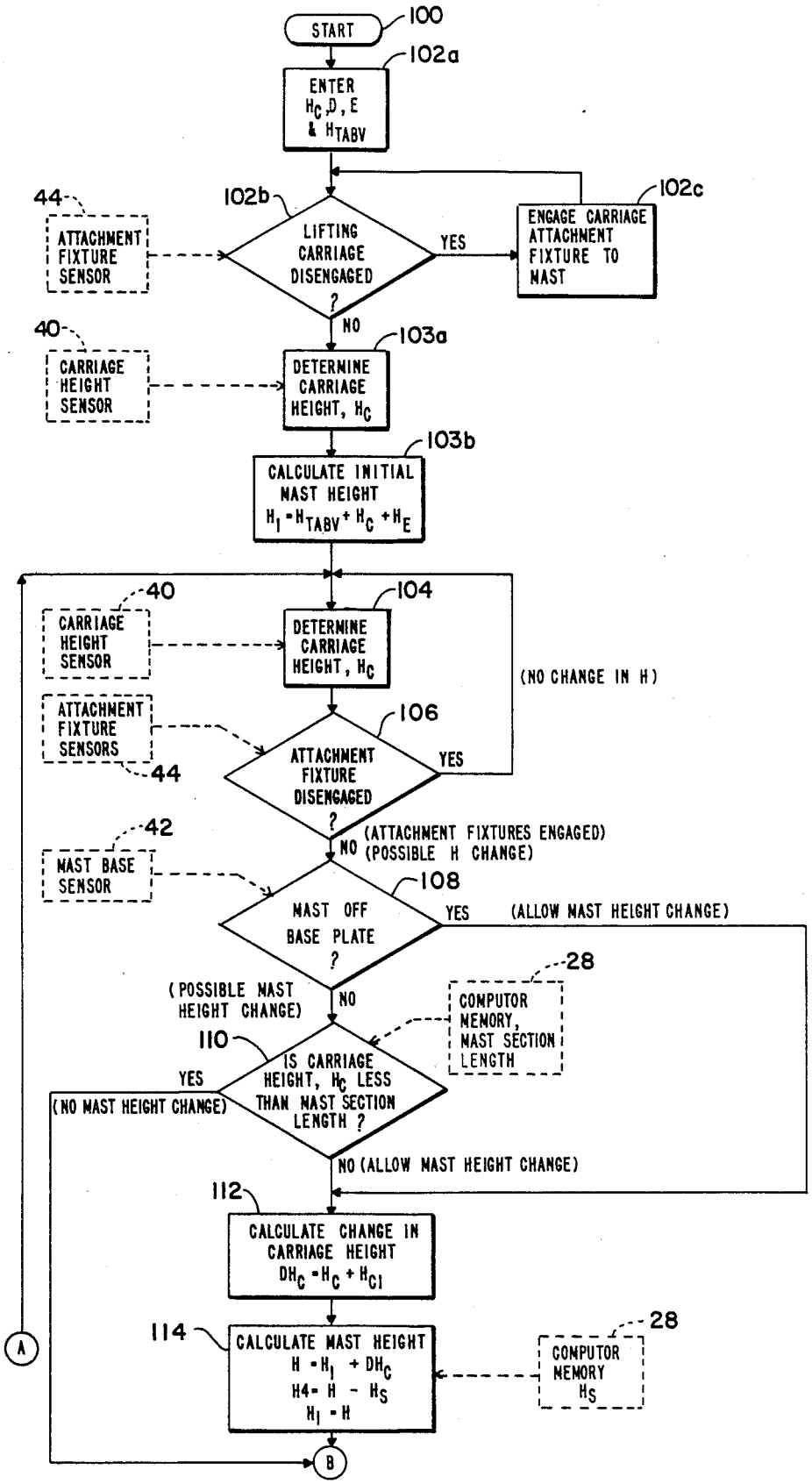
FIG. 5 is the first portion of a software flow diagram showing the operation of the software program of the present invention.
Figure 6:
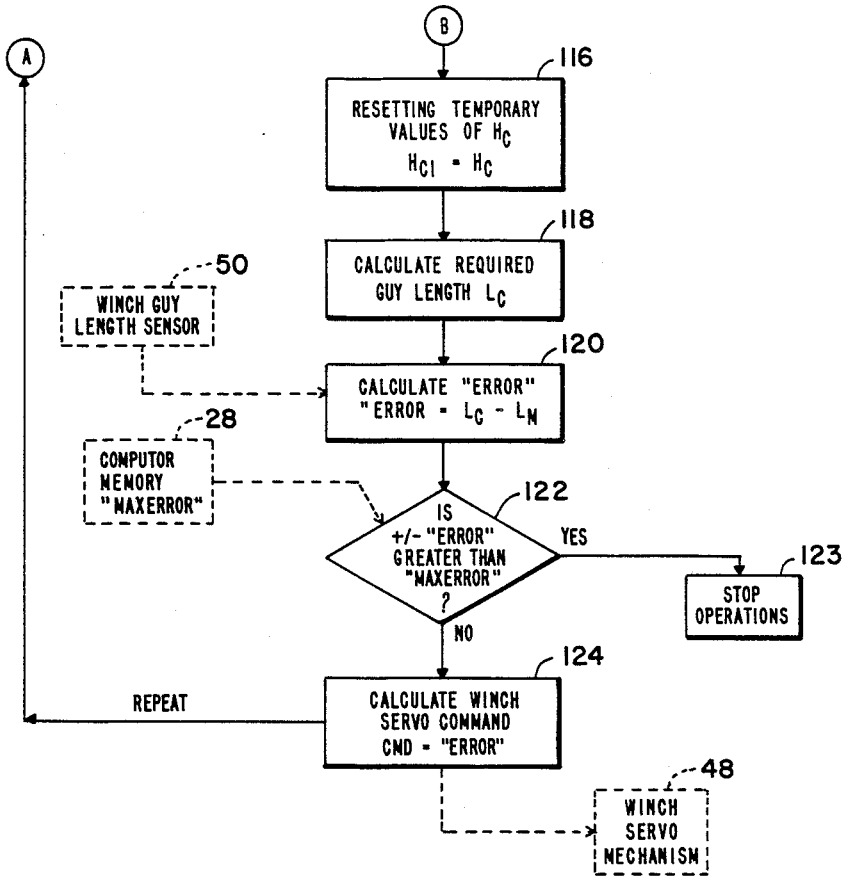
FIG. 6 is the second portion of the software flow diagram illustrated in FIG. 5.

Computer 28 is designed to control the operation of winches 26, so that the quantity of guy line 24 reeled out of the winches is such that mast 22 is maintained in a vertical position during assembly, disassembly, and when fully assembled. This control is effected (a) using information entered prior to the mast assembly or disassembly procedure, (b) using information received from carriage height sensor 38, mast base sensor 42, attachment fixture sensor 44, and guy length sensors 50, and (c) using a number of algorithms and set values stored in static memory of computer 28. The software flow diagram shown in Figs. 5 and 6 illustrates the steps followed in generating the control signals for controlling the operation of a single winch 26. As discussed in greater detail hereinafter, the operation of the other winches 26 are also controlled by computer 28 in accordance with the software flow diagram of FIGS. 5 and 6. Line by line coding of this software program is not provided inasmuch as such coding is believed to be clearly within the skill of an ordinary practitioner of the subject art.

After starting the winch control software program, as indicated by box 100, the values for $H_e$, D, E and $H_{tabv}$ are entered into computer 28 via keypad 60, as indicated by box 102*a*.

As discussed above, $H_e$ is the distance between flat surface 32 of mobile base 30 and the ground on which the mobile base rests. $H_e$ also is the distance between the bottom-most position of the vertical path lifting carriage 36 travels along vertical member 34 and the ground on which the mobile base 30 rests. This definition of $H_e$ assumes guy lines 24 exit winches 26 at ground level. However, as a practical matter, each guy line 24 typically exits the associated winch 26 a distance $H_w$ above the ground on which winch 26 is anchored. To correct for the fact that the guy lines do not exit the winches at ground level, $H_e$ is preferably adjusted by subtracting $H_w$ from the measured distance $H_b$ between flat surface 32 and the ground, i.e. $H_{e=Hb}-H_w$. Inasmuch as height $H_w$ is usually fixed by the design of the winch, it can be stored in computer memory and the computer can be programmed to perform the difference calculation producing the value for $H_e$ upon entry by the operator of the measured value for $H_b$. Notwithstanding the foregoing, for relatively tall masts this correction to $H_e$ has little effect on the accuracy of the optimal guy line length $L_c$ calculation described below.

$H_{tabv}$ is that length of mast 22 supported by lifting carriage 36 extending between the top of mast 22 and the location on lifting carriage 36 where attachment fixtures 38 are attached thereto. At the beginning of the mast erection procedure, $H_{tabv}$ is equal to the length of the top mast section. During a mast disassembly procedure, or after a restart, e.g. due to a power failure, the value $H_{tabv}$ will be equal to the vertical distance between attachment fixtures 38 and the top of the mast.

As for the other values entered at step 102*a*, as discussed above, D is the horizontal distance between the long axis of mast 22 and the winch 26 of interest, and E is the elevation distance between the ground on which mobile base 30 rests and the ground on which the winch rests.

The value of $H_e$, or $H_b$ where $H_e$ is corrected to account for $H_w$, may be measured by a tape measure. Depending upon the placement of winch 26 relative to mobile base 30, it may be necessary to measure distances D and/or E using a line and transit in conjunction with a tape measure. Assuming all of the sections of mast 22 are of equal length, $H_{tabv}$ can be determined by multiplying the number of sections times the length of a section and then subtracting from that result the length, if any, of the mast extends below attachment fixtures 38. A true value for $H_{tabv}$ can only be determined when mast 22 is engaged with lifting carriage 36.

Next, at step 102*b*, a determination is made if lifting carriage 36 is disengaged from mast 22. This determination is made using information provided in the output signal of attachment fixture 44. If lifting carriage 36 is disengaged from mast 22, then the operator is provided with an opportunity to couple atachment fixtures 38 with a section of mast 22, as indicated by box 102*c*. The program then returns to step 102*b* where a determination is again made if lifting carriage 36 is disengaged from mast 22. If it is determined that lifting carriage 36 is not disengaged from mast 22, then the program proceeds to step 103*a*.

At step 103*a*, the current value for the height $H_c$ attachment fixtures 38 are positioned above surface 32, as provided in the output signal of carriage height sensor 40, is retrieved.

Then, at step 103*b*, the initial height $H_1$ of mast 22 is calculated by adding $H_{tabv}+H_{c+He}$. These latter values were entered at step 102*a*.

At the next step, as indicated by box 104, the current value for the height $H_c$ attachment fixtures 38 are positioned above surface 32, as provided in the output signal of carriage height sensor 40, is again retrieved.

Next, at step 106, using the information contained in the output signal of attachment fixture sensor 44, a determination is made as to whether or not attachment fixtures 38 are disengaged from mast 22. If a "disengage" signal is received from sensor 44, then the software program returns to step 104 and the program continues the iteration comprising steps 104 and 106 until an "engage" signal is received. The software program is structured in this manner to speed processing and so that changes in the output signal of carriage height sensor 40 generated when a mast section is not coupled with attachment fixtures 38 do not affect the current value for $H_c$. When an "engage" signal is received from attachment fixture 44, the program proceeds to step 108.

At step 108, a determination is made if a section of mast 22 is contacting mast base sensor 42. If an "up" signal is received from mast base sensor 42, indicating mast 22 is not contacting the sensor, then the program proceeds to step 112. Thus, the program proceeds from step 108 to step 112 only when attachment fixtures 38 are engaged with mast 22 and the latter has been elevated by lifting carriage 36 above the surface on which mast base sensor is mounted. When a "down" signal is received from mast base sensor, indicating that mast 22 is contacting mast base sensor 42, then the program goes to step 110.

A determination is made at step 110 if the height $H_c$ lifting carriage 36 is elevated above surface 32 is less than the length of a single section of mast 22, it being assumed all mast sections are of equal length. This determination is made using the current value for $H_c$ and a value for mast section length stored in the memory of computer 28. If $H_c$ is less than the length of a section of mast 22, then the program proceeds to step 116. Practically speaking, (a) $H_c$ is less than the length of a section of mast 22 and (b) mast 22 contacts mast base sensor 42 (the conditions that exist when the program goes from step 110 to step 116) when lifting carriage 36 is being moved down vertical member 34 to be attached to the bottom of the bottom-most mast section which has been attached to the next mast section but not yet raised. Under these circumstances, changes in the output signal of carriage height sensor 40 mast not be used in determining the total height H of the mast when it is positioned on the surface of mobile base 30 since the height of the mast is not being changed. The procedure for calculating total height H is discussed below in connection with the description of steps 112 and 114.

If it is determined at step 110 that height $H_c$ is not less than the height of a section of mast 22, then the program proceeds to step 112. Thus, the conditions necessary for the program to proceed to step 112 are either (a) mast 22 must not contact mast base sensor 42 and attachment fixture 38 must engage mast 22 or (b) the mast must contact mast base sensor 42, attachment fixtures 38 must engage mast 22, and the height $H_c$ must be greater the length of a section of mast 22. The former condition exists when mast 22 is attached to, and is being raised or lowered by, lifting carriage 36. The latter condition exists when the bottom of a new mast section rests on flat surface 32 and it is necessary to elevate the next-to-the-last mast section few inches so that the top of the new mast section will fit underneath the next-to-the-last section.

Next, at step 112, the change in height $H_c$ over the iteration comprising steps 104–124 is calculated by subtracting the current value for $H_c$ as provided in the output signal from carriage height sensor 40, from the last value for $H_c$ identified as $H_{c1}$. The result of this calculation is identified as $DH_c$.

The program now proceeds to step 114 where the total height H of mast 22 is calculated. For the first iteration of the program, total height H of mast 22 is calculated by adding the initial mast height $H_1$ calculated at step 103*b* to the change in height $DH_c$ calculated in step 112 to arrive at a new total height H.

For the second and subsequent iterations, $H_1$ is the last-calculated total height H. Thus, at the end of step 114 $H_1$ is set equal to the value for total height H calculated at the beginning of step 114.

Also at step 114, a value for height H4 is calculated by subtracting height $H_s$ retrieved from the memory of computer 28 from the last calculated total height H. Height $H_s$ is equal to the spacing between the position on mast 22 where the top-most course of guy lines 24 is attached and the position where the second, lower course of guy lines 24 is attached. Of course, $H_s$ will be equal to zero when only one course of guy lines is used. Height H4 is equal to the total height or distance between the surface on which mobile base 30 rests and the second course or guy lines 24.

Next, at step 116, the value for height $H_{c1}$ is generated by setting $H_{c1}$ equal to the current value for $H_c$ provided by carriage height sensor 40.

Thereafter, at step 118, an optimal length $L_c$ guy line 24 to be unreeled from winch 26 is calculated. Length $L_c$ is equal to the length that the guy line 24 of interest should be to ensure mast 22 is supported in a vertical position. Thus, distance $L_c$ is equal to the distance between the location on mast 22 where the top end of the guy line of interest is attached and the location on winch 26 where the other of end of the guy line first makes contact with the winch, when mast 22 is supported in a vertical position.

Length $L_c$ is calculated using (a) well known geometric and trigonometric formulae and (b) the values for D and E entered at step 102*a* and the value for H calculated at step 114 and, where $H_s$ does not equal 0 and length $L_c$ is being determined with respect to a guy line on the second course of guy lines, using the value for H4 also calculated at step 114. The specific trigonometric and geometric formulae used will, of course, depend upon if E is taken as the vertical distance between winch 26 and a horizontal plane intersecting the ground on which mobile base 30 rests or if E is taken as the angle between (1) a straight line from winch 26 to the ground on which mobile base 30 rests and (2) a horizontal plane intersecting the ground on which the mobile base 30 rests.

Next, at step 120 the difference between lengths $L_c$ and $L_m$ is determined by subtracting $L_m$ from $L_c$. This difference length is identified as "Error". The value for $L_c$ is calculated at step 118 and the value for $L_m$ is provided in the output signal of cable length sensor 50. "Error" will be either a positive or a negative value, with the sign of "Error" being used to control the direction winch 26 rotates, as discussed below in conjunction with step 124.

The program then proceeds to step 122 where the absolute value of the length difference "Error" is compared to a predetermined length value identified as "Maxerror" and stored in the memory of computer 28. If "Error" is greater than "Maxerror" then computer 28 sends out stop signals to servo mechanisms 37 and 48, as identified by step 123, which causes the servo mechanisms to stop the operation of lifting carriage 36 and winches 26, respectively. If "Error" is not greater than "Maxerror" then the program proceeds to step 124.

At step 124, a control signal is generated which contains information to be used by servo mechanism 48 in controlling the operation of winch 26. This information relates to both the direction of travel of winch 26 and the length of guy line 24 that is reeled in or fed out by winch 26. The control signal is generated so as to cause winch 26 to reel in or feed out guy line 24 for a period of time such that the length of guy line reeled in or fed out is equal to the distance "Error". The sign of "Error" determines the direction servo mechanism 37 causes winch 26 to rotate. When "Error" is positive servo mechanism 37 causes winch 26 to feed out guy line 24 and when "Error" is negative servo mechanism causes winch 26 to reel in guy line 24.

Lifting apparatus 20 is not designed to control the tension of guy lines 24 in a direct manner. Thus, winches 26 adjust the lengths of guy lines 24 based only on the results of the $L_c-L_m$ difference calculation. In attempting to carry out the command contained in the control signal (box 124), winches 26 will supply torque up to their "stall" point. Of course, in accordance with standard design practices, the torque capacity of the winches is designed to exceed the expected tension encountered during raising and lowering of mast 22. If the winches "stall" or stop for any reason, the difference $L_c-L_m$ (box 120) will exceed a preset maximum allowable value. In turn, computer 28 will send a stop signal to lifting carriage servo mechanism 37 and winch servo mechanisms 48 which will stop the operation of the lifting carriage and the winches.

The above-described winch control program is also used to control the operation of the other winches 26 of the present invention. However, each winch 26 is controlled independently of the other winches. As such, the winch control program described above and illustrated in FIGS. 5 and 6 is run simultaneously by computer 28 for each of the winches 26, with unique control signals being generated at step 124 for each of the winches 26. As a result of this independent control, unequal lengths of guy line may be reeled in or payed out, as compared between the several winches 26 over some short interval of time, and some of the winches may be reeling in guy line at the same time other winches are feeding out guy line. Thus, each winch 26 is operated independently so as to ensure the length of guy line 24 unreeled therefrom is that length which causes mast 22 to be supported vertically with respect to that winch. The combined effect of this independent operation is the lengths of guy line unreeled from all of the winches are those lengths which, when acting together, cause mast 22 to be supported in a vertical position.

The winch control software may be modified to include monitoring steps where the condition of an emergency stop button on keypad 60 and the voltage of the power supply (not shown) for lifting apparatus 20 is continuously monitored. When the emergency stop button is depressed, computer 28 sends a stop signal to servo mechanisms 37 and 48, as at step 123, instructing the servo mechanisms to stop the operation of lifting carriage 36 and winch 26, respectively. Similarly, if an insufficient output voltage is provided by the power supply, a stop signal is provided to servo mechanisms 37 and 48.

Mast 22 may be erected using lifting apparatus 20 in accordance with the following steps. After moving mobile base 30 to the location where mast 22 is to be erected, the mobile base is leveled so that flat surface 32 is parallel to sea level. As a result of this leveling, the long axis of vertical member 34 is substantially vertical, i.e. perpendicular to sea level.

Next, sites are selected where each of the winches 26 are anchored. As is well known, these sites are spaced a distance from the location where mast 22 is erected that depends upon the desired final height of the mast. As is also known, the winch sites are angularly distributed around the mast erection site such that the angular spacing between adjacent sites is substantially equal. For instance, where three winches 26 are used each of the winches are spaced about 120° from the other winches, or where four winches 26 are used each of the winches are spaced about 90° from the other winches.

Next, after the values for $H_e$, D, E, and $H_{tabv}$ have been entered into computer 28, mast erection begins by raising the top-most mast section to a vertical position and then positioning the section so that the bottom end thereof rests on the flat plate covering aperture 33 or on the ground, depending upon whether mobile base 30 terminates at or extends beyond vertical member 34. When the mast section is in this position, mast base sensor 42 will provide a "down" signal. Next, guy lines 24 are secured to the top-most mast section. The latter is then attached to lifting carriage 36 via attachment fixtures 38. As noted above, when attachment fixtures 38 are coupled with a section of mast 22, attachment fixture sensor 44 provides an "engage" signal.

The mast erection procedure begins when the operator enters the appropriate "up" command at keypad 60 or at the separate control switch for lifting carriage 36, as the case may be. Entry of this command provides an "up" signal to servo mechanism 37 which in turn causes lifting carriage 36 to move up vertical member 34. As a result of this upward movement, the value for $H_c$ contained in the output signal of length sensor 40 increases. Additionally, as soon as lifting carriage 36 raises the top-most mast section off the flat plate covering aperture 33 or off the ground, mast base sensor provides an "up" signal.

Under the direction of the winch control program illustrated in FIGS. 5 and 6 and discussed above, winches 26 pay out guy line 24 as lifting carriage 36 raises the top-most section of mast 22 vertically away from flat top surface 32 of mobile base 30. As also discussed above, the operation of each winch 26 is controlled, based on the information contained in the control signal generated at step 124 of the winch control software program, so that the length of cable extending between mast 22 and the winch 26 is such that the mast is maintained in a substantially vertical position. Of course, when mast 22 is supported in a vertical position, the portion of the mast where guy lines 24 are attached is positioned directly vertically above the bottom of the mast.

When the top-most section of mast 22 has been raised above flat surface 32 of mobile base 30 a distance such that another mast section can be inserted between the flat surface of the mobile base and the bottom of the top-most mast section, lifting carriage 36 is stopped. Lifting carriage 36 may be stopped by entering an appropriate command at keypad 60, or at the switch associated with the lifting carriage if such a switch is provided. Alternatively, if a stop sensor is provided near the top of vertical member 34, as discussed above, lifting carriage 36 will stop automatically when it reaches the stop sensor.

A second mast section is then attached to the bottom of the top-most mast section and lifting carriage 36 is caused to move down vertical member 34 until the bottom of the second member rests on flat surface 32 of mobile base 30. As noted above, when a mast section is attached to lifting carriage 36, the value for $H_c$ in the output signal of length sensor 40 increases as the lifting carriage moves up vertical member 34 and decreases as the lifting carriage moves down vertical member 34. Thus, when the second mast section is moved down to rest on flat surface 32, the value for $H_c$ in the output signal of length sensor 40 decreases. Alternatively, the second mast section may be initially positioned to rest on the flat plate covering aperture 33 or on the ground and the top mast section may be lowered into engagement with the second section and then secured together.

Lifting carriage 36 is then detached from the bottom of the top-most mast section and is caused to move down vertical member 34 until it contacts or nearly contacts flat surface 32 of mobile base 30. As noted above, when lifting carriage 36 is detached from a mast section, attachment fixture 44 provides a "disengage" signal. Thus, as lifting carriage 36 travels down vertical member 34 unattached to a mast section no new winch control signals are generated because the winch control program repeatedly loops through steps 104 and 106 so long as attachment fixture sensor 44 provides a "disengage" signal and hence the program never reaches step 124 where the winch control signals are generated.

Lifting carriage 36 is then attached to the bottom of the second mast section and the lifting carriage is caused to move up vertical member 34. As lifting carriage 36 moves up vertical member 34, both the second and the top-most mast sections are lifted vertically away from flat surface 32. Winches 26, under the control of computer 28 programmed in accordance with the software flow diagram set forth in FIGS. 5 and 6, feed out guy line 24 so as to (a) permit the assembled sections of mast 22 to be raised and (b) so as to support mast 22 in a vertical position. When the second mast section has been raised above flat surface 32 a distance sufficient to permit a third mast section to be attached to the bottom of the second mast section, lifting carriage 36 is stopped and the third mast section is attached to the second mast section.

The third and subsequent mast sections are raised in the manner discussed above with respect to the top-most and second mast sections. After lifting carriage 36 has lifted the next-to-the-last mast section a sufficient distance, the flat plate covering aperture 33 in base 30 is removed and the bottom-most mast section is positioned on the ground or on a suitable footing directly beneath aperture 33. Lifting carriage 36 then lowers the next-to-the-last mast section until it rests on the bottom mast section, and the two sections are then attached together.

Because aperture 33 is open to the end of mobile base 30, after lifting carriage 36 has been detached from mast 22, the mobile base merely surrounds and does not engage the mast. As such, mobile base 30 is free to be moved to another mast erection site. In this connection, guy lines 24 are typically detached from winches 26 and are anchored to the ground using conventional cable anchors when the mast is to remain permanently erected.

When mast lifting assembly 20 is used to erect a temporary mast, mobile base 30 is generally not moved away from the mast erection site and the bottom-most mast section is positioned to rest on flat surface. Similarly, guy lines 24 are typically not detached from winches 26.

To facilitate the raising of new mast sections, a short lift rope may be attached to the bottom of the mast section being raised by lifting carriage 36. The other end of the rope is attached to the top of the next mast section located in a horizontal storage position adjacent lifting apparatus 20. As a result of this attachment, the mast section being raised will pull the new mast section from the horizontal storage position to a vertical position directly beneath the mast section being raised.

Mast lifting apparatus 20 may also be used to disassemble an erected mast. Mast disassembly is effected by reversing the procedure described above to erect a mast. Computer 28 controls the operation of winches 26 in accordance with the winch control software illustrated in FIGS. 5 and 6 so as to ensure mast 22 remains substantially vertical while being disassembled.

An important advantage of the present invention is that masts can be erected on terrain which necessitates positioning the winches above or below the ground level where the mast is assembled or disassembled.

Another advantage of the present invention is that mast assembly personnel do not have to climb the mast to attach guy lines and subsequent sections inasmuch as the mast is assembled from the bottom up.

Yet another advantage of the present invention is that relatively tall masts, i.e. 250 feet or more, can be safely and quickly assembled since the computer-controlled winches ensure the mast is supported in a nearly vertical position during the entire assembly procedure.

Since certain changes may be made in the above apparatus and method without departing from the scope of the invention herein involved, it is intended that all matter contained in the above description or shown in the accompanying drawings shall be interpreted in an illustrative and not in a limiting sense.

What is claimed is:

1. A system for assembling and disassembling a plurality of elongate mast sections adapted to be attached together in end-to-end configuration so as to form a unitary mast, the system comprising:

a base defining a reference plane spaced a distance $H_e$ above the surface on which the base rests;

lifting means attached to said base for moving said mast up and down along a vertical path having a length greater than the length of one of said plurality of sections, said lifting means comprising a lifting carriage which is releasably couplable with each of said plurality of mast sections and is adapted to move up and down along said vertical path;

a plurality of guy lines each having first and second ends, said first ends of said guy lines being attached to said mast at a selected location thereon;

a plurality of winch means, each for reeling in and feeding out a corresponding respective one of said plurality of guy lines, each of said plurality of winch means being attached to said second end of said corresponding respective one of said plurality of guy lines and being spaced (1) a distance D from said mast, as measured along a horizontal axis and (2) a distance E above or below a horizontal plane intersecting the surface on which said base rests, as measured along a vertical axis, each of said plurality of winch means being adapted to reel in or feed out a length of said corresponding respective one of said plurality of guy lines upon receipt of a first control signal which length depends upon information contained in said first control signal, each of said plurality of winch means being adapted to be anchored to a surface;

first length sensor means coupled to said lifting means for providing a first output signal that is representative of the distance $H_c$ said lifting carriage is spaced from said reference plane, as measured along the length of said mast;

a plurality of second length sensor means, each being coupled to a corresponding respective one of said plurality of winch means, each for providing a second output signal that is representative of the length $L_m$ of that portion of said corresponding respective one of said plurality of guy lines which has been unreeled from said one of said plurality of winch means; and computer means coupled to said first length sensor means, said plurality of second length sensor means, and said plurality of winch means for generating a unique first control signal for each of said plurality of winch means and for providing each of said unique first control signals to a corresponding respective one of said plurality of winch means, said unique first control signals being generated so as to contain information which causes each of said plurality of winch means to reel in and feed out said corresponding respective one of said plurality of guy lines such that said lengths of said plurality of guy lines unreeled from said plurality of winch means are those lengths which cause said mast to be supported in a substantially vertical position during the assembly or disassembly thereof.

2. A system according to claim 1 further comprising keypad means for use in providing values to said computer means (a) for said distances D and E for each of said plurality of winch means and (b) for said distance $H_e$, further wherein said computer means is designed to generate said first control signal for each of said plurality of winch means based on information contained in said first and second output signals and based on the values for said distances D, E and $H_e$.

3. A system according to claim 2 wherein said computer means comprises calculating means for calculating an optimal length $L_c$ of guy line to be unreeled from each of said plurality of winch means using trigonometric formulae, information contained in said first output signal and said second output signals, and the values for said distances D, E and $H_e$, said optimal lengths $L_c$ being calculated so as to be equal to those lengths of guy line which when coupled between said selected location on said mast and respective ones of said plurality of winch means will act together so as to support said selected location directly vertically above the bottom of said mast whereby said mast is supported in a substantially vertical position.

4. A system according to claim 3, further wherein said calculating means is designed to subtract each of said optimal lengths $L_c$ from the length $L_m$ contained in the second output signal provided by the one of said plurality of second length sensor means coupled with the one of said plurality of winch means for which said each optimal length $L_c$ was calculated so as to provide a difference value, further wherein said computer means is designed to generate each of said first control signals provided to respective ones of said plurality of winch means based on the respective one of these difference values.

5. A system according to claim 1 wherein said lifting carriage is designed to slidably engage said elongate member so as to be movable along the length of said elongate member, said lifting means further comprising:

an elongate member attached to said base so as to extend perpendicular to said reference plane; and motor means coupled to said lifting carriage for causing said lifting carriage to move up and down along the length of said elongate member.

6. A system according to claim 1 wherein each of said plurality of winch means comprises:

a rotatable winch designed to reel in a corresponding respective one of said plurality of guy lines wound around said rotatable winch when the latter is rotated in a first direction and to feed out said corresponding respective one of said plurality of guy lines when said winch is rotated in a second direction;

a reversible motor coupled to said winch for causing said winch to rotate in said first and second directions;

a servo mechanism coupled to said motor for causing said motor to operate (a) for a period of time and (b) in either a forward or a reverse direction, based upon the information contained in said first control signal so as to cause said winch to reel in or feed out said corresponding respective one of said plurality of guy lines, said servo mechanism being coupled to said computer means so as to receive said first control signal.

7. A system according to claim 4 wherein said first length sensor means is designed so that said distance $H_c$ represented in said first output signal varies substantially instantaneously as said lifting carriage is caused to move up and down said elongate member.

8. A system according to claim 1 said assembly further comprising:

a second plurality of guy lines having first and second ends, said first ends of said guy lines being attached to said mast at a second predetermined location that is spaced a distance $H_s$ from said selected location;

a second plurality of winch means each for storing and for reeling in and feeding out a corresponding respective one of said second plurality of guy lines, each of said second plurality of winch means being attached to said second end of said corresponding respective one of said second plurality of guy lines and being spaced (1) a distance D from said mast, as measured along a horizontal axis and (2) a distance E above or below a horizontal plane intersecting the surface on which said base rests, as measured along a vertical axis, each of said second plurality of winch means being adapted to reel in or feed out a length of said corresponding respective one of said second plurality of guy lines upon receipt of a second control signal which length depends upon information contained in said second control signal, each of said second plurality of winch means being adapted to be anchored to a surface;

a second plurality of second length sensor means, each being coupled to a corresponding respective one of said second plurality of winch means, each for providing a second output signal that is representative of the length $L_m$ of that portion of said corresponding respective one of said second plurality of guy lines which has been unreeled from said one of said second plurality of winch means;

said computer means also being coupled to said second plurality of winch means, and said second plurality of second length sensor means, said computer means being designed to generate unique second control signals for each of said second plurality of winch means and to provide each of said second control signals to respective ones of said second plurality of winch means, said second control signals being generated so as to contain information which causes each of said second plurality of winch means to reel in and feed out said corresponding respective one of said second plurality of guy lines such that the lengths of said second plurality of guy lines unreeled from said second plurality of winch means are those lengths which cause said mast to be supported in a substantially vertical position during the assembly or disassembly thereof.

9. Apparatus for assembling or disassembling a plurality of elongate mast sections adapted to be attached together end-to-end so as to form a unitary mast, said apparatus comprising:

a frame comprising a reference surface;

a lifting carriage attached to said frame and couplable with at least one of said sections of said mast, said lifting carriage being adapted to move said mast up and down along a vertical path;

a plurality of guy lines each having first and second ends, said first ends being attached to said mast at a selected position thereon;

a plurality of winch assemblies each adapted to be anchored to a surface, each of said plurality of winch assemblies comprising a rotatable winch operable in either a forward or a reverse direction for feeding out or reeling in, respectively, a corresponding respective one of said plurality of guy lines, and a motor for causing said winch to rotate in either said forward direction or said reverse direction upon receipt of a control signal, wherein the direction in which each of said motors causes said corresponding respective one of said plurality of winches to rotate and the length of time said each of said motors causes said corresponding respective one of said plurality of winches to rotate in said forward direction or said reverse direction is based upon information contained in said control signal;

a first length sensor coupled to said lifting carriage and designed to provide a first output signal (1) which is representative of the height said lifting carriage is positioned above said reference surface and (2) which varies continuously as said lifting carriage moves along said vertical path;

a plurality of second length sensors each coupled to a corresponding respective one of said plurality of winch assemblies, each of said plurality of second length sensors being designed to provide a second output signal which is representative of the length of said corresponding respective one of said plurality of guy lines which has been unreeled from the one of said plurality of winch assemblies to which said each plurality of second length sensors is coupled; and a computer coupled to each of said motors of said plurality of winch assemblies, to said first length sensor, and to said plurality of second length sensors, for generating a unique one of said control signals for each of said motors based on information contained in said first output signal, said second output signals, the distance each of said winch assemblies is spaced horizontally and vertically from the surface on which said lifting carriage rests, the distance said reference is positioned above said surface on which said lifting carriage rests, and trigonometric formulae, said control signals being generated to contain information which when received by said motors will cause said motors to operate in either said forward or reverse directions and for periods of time so that the lengths of said plurality of guy lines unreeled from said plurality of winches are such that said plurality of guy lines acting together support said mast in a vertical position.

10. An apparatus for assembling and disassembling a plurality of elongate mast sections designed to be attached together in end-to-end configuration so as to form a unitary mast, the system comprising:

lifting carriage means for raising or lowering a mast from the bottom end thereof;

a plurality of winches for unreeling guy line attaching thereto and also attached to said mast based on information contained in control signals provided to said winches so that the lengths of guy line unreeled from said plurality of winches are such that said guy lines acting together cause said mast to be supported in a vertical position as said mast is raised, lowered or supported in an immobile state by said lifting carriage means; and computer means for generating a unique one of said control signals for each of said plurality of winches.

* * * * *